US008282251B2

(12) United States Patent
Fournier et al.

(10) Patent No.: US 8,282,251 B2
(45) Date of Patent: Oct. 9, 2012

(54) FLAMELESS ELECTRONIC CANDLE

(75) Inventors: Bernard Fournier, Delson (CA); Mathieu Chartrand, Quebec (CA)

(73) Assignee: NII Northern International, Inc. (CA)

( * ) Notice: Subject to any disclaimer, the term of this patent is extended or adjusted under 35 U.S.C. 154(b) by 133 days.

(21) Appl. No.: 13/016,570

(22) Filed: Jan. 28, 2011

(65) Prior Publication Data

US 2012/0195030 A1 Aug. 2, 2012

(51) Int. Cl.
*F21V 15/01* (2006.01)

(52) U.S. Cl. ..... 362/392; 362/569; 362/249.05

(58) Field of Classification Search ..... 362/157, 362/392, 569, 161, 181, 190, 191, 194–202, 362/645–653, 658–659, 806, 810, 249.01, 362/249.02, 249.05
See application file for complete search history.

(56) References Cited

U.S. PATENT DOCUMENTS 2,600,418 A * 6/1952 Muller ..... 362/194
5,363,291 A * 11/1994 Steiner ..... 362/191
5,437,066 A * 8/1995 Mills et al. ..... 4/661
6,454,425 B1 9/2002 Lin
7,178,939 B2 2/2007 Tsai
7,387,411 B1 6/2008 Tsai
7,633,232 B2 12/2009 Wong
2003/0058646 A1* 3/2003 Chang ..... 362/253
2011/0069481 A1* 3/2011 Chen ..... 362/191

OTHER PUBLICATIONS

PCT, Notification of Transmittal of the International Search Report and the Written Opinion of the International Searching Authority, in International application PCT/CA2012/00039, dated Apr. 19, 2012.

* cited by examiner

*Primary Examiner* — Joseph L Williams
*Assistant Examiner* — Fatima Farokhrooz
(74) *Attorney, Agent, or Firm* — McAndrews, Held & Malloy, Ltd.

(57) ABSTRACT

According to embodiments of the present invention, a flameless candle includes a slide member including a protrusion and a nose. The flameless candle also includes a base including a radial aperture in a horizontal plane. The radial aperture is configured to receive the protrusion and permit a movement of the slide member in a corresponding radial direction. The slide member has an ON position when the protrusion is located at an inwards position along the radial direction. The slide member also has an OFF position when the protrusion is located at an outwards position along the radial direction. The flameless candle also includes a battery contact including a rotatable portion and a mechanical contact portion. In an embodiment, the rotatable portion is configured to rotate in a vertical plane. The nose of the slide member is configured to rotate the rotatable portion as the slide member moves between the ON position and the OFF position, and cause the mechanical contact portion to contact a battery when the slide member is in the ON position.

16 Claims, 12 Drawing Sheets

FLAMELESS ELECTRONIC CANDLE

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Generally, the present application relates to flameless candles. Particularly, the present application relates to the mechanical and electrical construction of battery-powered flameless electronic candles.

Flameless electronic candles have provided an alternative to conventional candles. Some types of flameless electronic candles include tea candles, votive candles, pillar candles, or other types of candles. Flameless candles can simulate the flickering effect of a real candle without the danger of an open flame. Some such techniques are described in U.S. Pat. No. 6,616,308. Flameless candles may include various parts, including a lamp, battery contacts, and a switch. These parts, individually or in combination, may add cost and complexity to the flameless candle.

Currently, a flameless candle is known to include a tangentially oriented switch to toggle power on and off. FIGS. 1A-1E show a prior art flameless candle 100. As shown in FIG. 1B, the candle 100 includes a flame 101, a housing 102, a light emitting diode ("LED") 103, a slide member 104, a battery contact 105, a base 106, a pull tab 107, a battery 108, and a spring door 109.

Turning to FIG. 1C, the prior art slide member 104 is shown in more detail. The slide member 104 includes a protrusion 112, a first lateral portion 113, a second lateral portion 114, a spring arm 115, and a bump 116. The protrusion 112 is configured to allow a user to move the position of the slide member 104. The protrusion 112 protrudes downwardly from the general plane of the slide member 104 (as generally seen in FIG. 1B). The first lateral portion 113 is sloped or tapered along its length. Because of this slope or taper, the slide member 104 has varying width along its length.

The second lateral portion 114 is connected to the spring arm 115. The spring arm 115 is capable of moving in a general radial direction around the connection between the second lateral portion 114 and the spring arm 115. The spring arm 115 further includes a bump 116.

Turning to FIG. 1D, a sub-assembly of the flameless candle is shown, including the base 106, the battery contact 105, the LED 103, and the battery 108. As shown, the base 106 further includes a post 111 and a tangentially oriented aperture 110. The tangentially oriented aperture 110 is configured to receive the protrusion 112 of the slide member 104. The protrusion 112 is smaller in a length-wise direction than the tangentially oriented aperture 110. The protrusion 112, therefore, is capable of moving in a tangential direction along the length of the tangentially oriented aperture 110. The movement of the protrusion 112 causes a corresponding tangential movement of the slide member 104. The tangential movement is substantially tangential with respect to the round shape of the base of the flameless candle 100.

As further shown in FIG. 1D, the battery contact 105 includes a rotatable portion and a mechanical contact portion that is capable of contacting one terminal of the battery 108 (either the anode or the cathode). The battery contact 105 is oriented such that the rotatable portion rotates in a horizontal plane with respect to the base 106. The battery contact 105 is electrically connected to one lead of the LED 103. This electrical connection (e.g., a solder joint) is formed at a location to the side of the battery 108. The other lead of the LED 103 is arranged to contact the other terminal of the battery 108. When the battery contact 105 contacts the battery 108, a circuit is completed such that current will flow through the LED 103 to cause light to be emitted. The LED 103 may include an embedded flickering circuit to simulate the flickering of a candle flame. Also shown is a portion of the spring door 109.

Turning to FIG. 1E, the sub-assembly is shown including the slide member 104. The spring door 109 includes a spring portion that removably secures the spring door 109 to the base. As shown, the spring portion extends substantially beyond the battery compartment. The protrusion 112 has been inserted into the tangentially oriented aperture 110 (not shown). As the slide member 104 moves along a tangential direction, the width of the slide member 104 changes. As the width increases, the first lateral portion 113 puts increasing pressure on the battery contact 105. The rotatable portion of the battery contact 105 rotates in a horizontal plane, causing the battery contact 105 to electrically connect to one of the terminals of the battery 108. As the width of the slide member 104 decreases, the rotatable portion of the battery contact 105 again rotates in a horizontal plane and returns to a resting position. In the resting position, the mechanical contact portion of the battery contact 105 is no longer in contact with the battery 108.

As the slide member 104 moves along a tangential direction, the spring arm 115 is compressed and decompressed as the bump 116 moves across the post 111. The spring arm 115 moves in a horizontal plane. The tension between the spring arm 115, the post 111, and the bump 116 stabilize the tangential position of the slide member 104. As a user moves the protrusion 112, the bump 116 can cross the post 111, causing the slide member 104 to toggle between ON and OFF positions.

There exists a need for more compact and robust flameless electronic candles and switch configurations therein.

BRIEF SUMMARY OF THE INVENTION

According to embodiments of the present invention, a flameless candle includes a slide member including a protrusion and a nose. The flameless candle also includes a base including a radial aperture in a horizontal plane. The radial aperture is configured to receive the protrusion and permit a movement of the slide member in a corresponding radial direction. The slide member has an ON position when the protrusion is located at an inwards position along the radial direction. The slide member also has an OFF position when the protrusion is located at an outwards position along the radial direction. The flameless candle also includes a battery contact including a rotatable portion and a mechanical contact portion. In an embodiment, the rotatable portion is configured to rotate in a vertical plane. The nose of the slide member is configured to rotate the rotatable portion as the slide member moves between the ON position and the OFF position, and cause the mechanical contact portion to contact a battery when the slide member is in the ON position.

In an embodiment, base further includes a battery compartment configured to receive a battery and a battery compartment aperture. The mechanical contact portion is configured to contact the battery through the battery compartment aperture. In another embodiment, the flameless candle further includes an LED. The LED may include an embedded circuit configured to cause the LED to emit light simulating a candle flicker. A first lead of the LED may be connected to the battery contact, and a second lead of the LED may be fed into the battery compartment. When the mechanical contact portion contacts a first terminal of the battery and the second lead of the LED contacts the second terminal of the battery, a current may flow through the LED.

In an embodiment, the base includes a battery compression arm configured to push the second lead of the LED against the second terminal of the battery. The flameless candle may also include a door. The door may be a bayonet door that has flanges and is configured to rotatably mate with a grooved portion on the base. The door is also configured to contain the battery within the battery compartment. Further, the door is configured to push the battery towards the battery compression arm and the second lead of the LED and cause the battery compression arm to compress. When compressed, the battery compression arm is configured to push the second lead of the LED against the second terminal of the battery.

In an embodiment, the first lead of the LED is connected to the battery contact at a location above the battery. In another embodiment, the flameless candle includes a drawer configured to slidably engage with the base and to prevent the slide member from being displaced. In another embodiment, the flameless candle includes a bayonet door configured to rotatably mate with the base and to contain the battery within the battery compartment.

In an embodiment, the flameless candle includes a post and the slide member includes a spring arm. The spring arm is configured to be decompressed when the slide member is in the ON position and the OFF position, and compressed when a bump on the spring arm crosses the post as the slide member travels between the ON position and the OFF position. The spring arm is further configured to snap the slide member into the ON/OFF positions as the slide member is travelling towards the ON/OFF positions respectively.

Figure 1A:
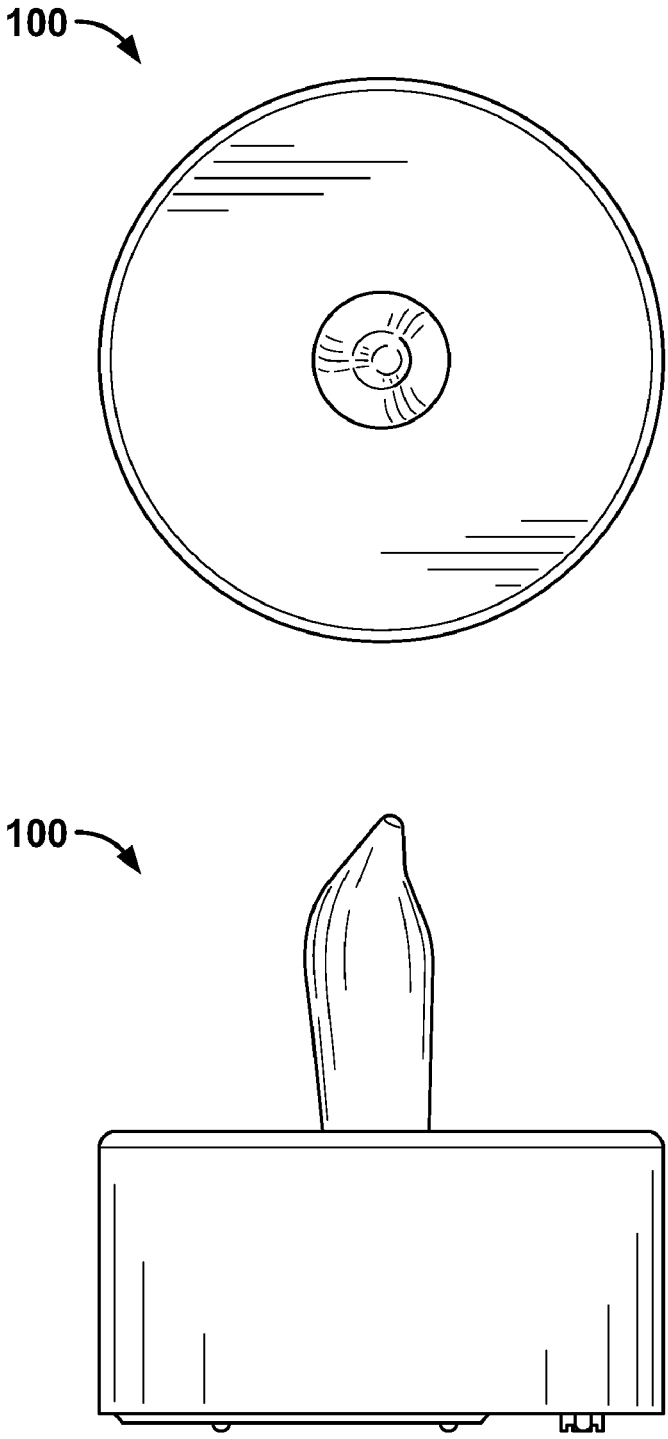
FIG. 1A (Prior Art)
FIG. 1A shows a flameless candle.
Figure 1B:
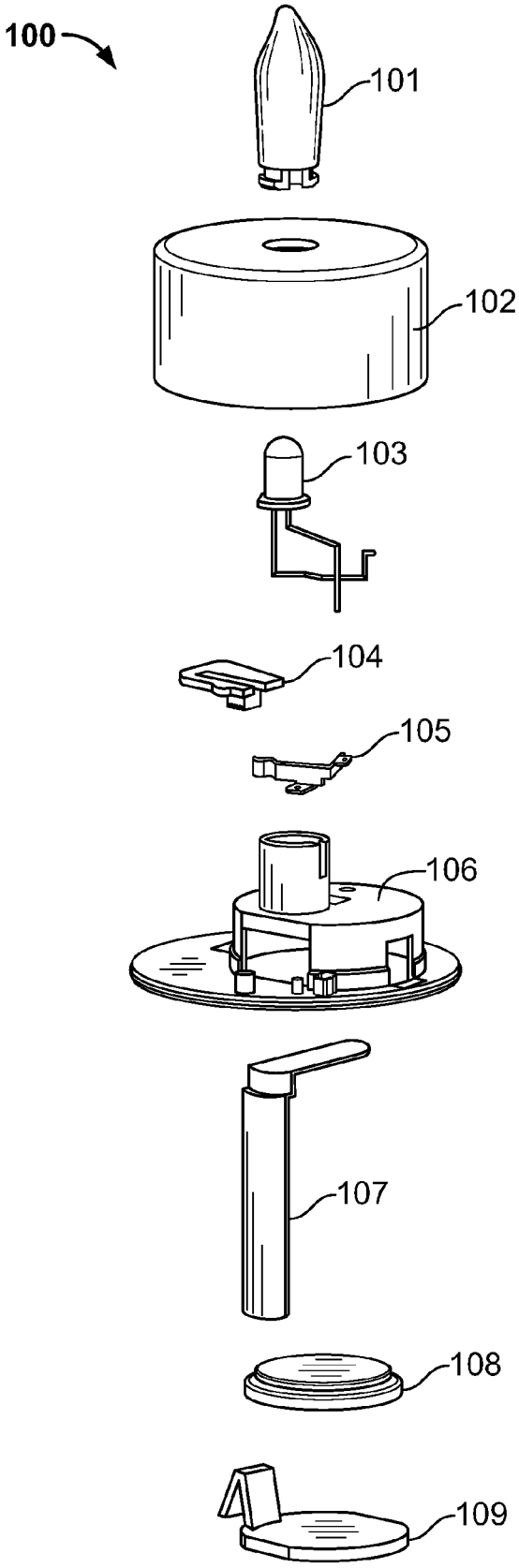
FIG. 1B (Prior Art)
FIG. 1B shows an exploded view of a flameless candle.
Figure 1C:
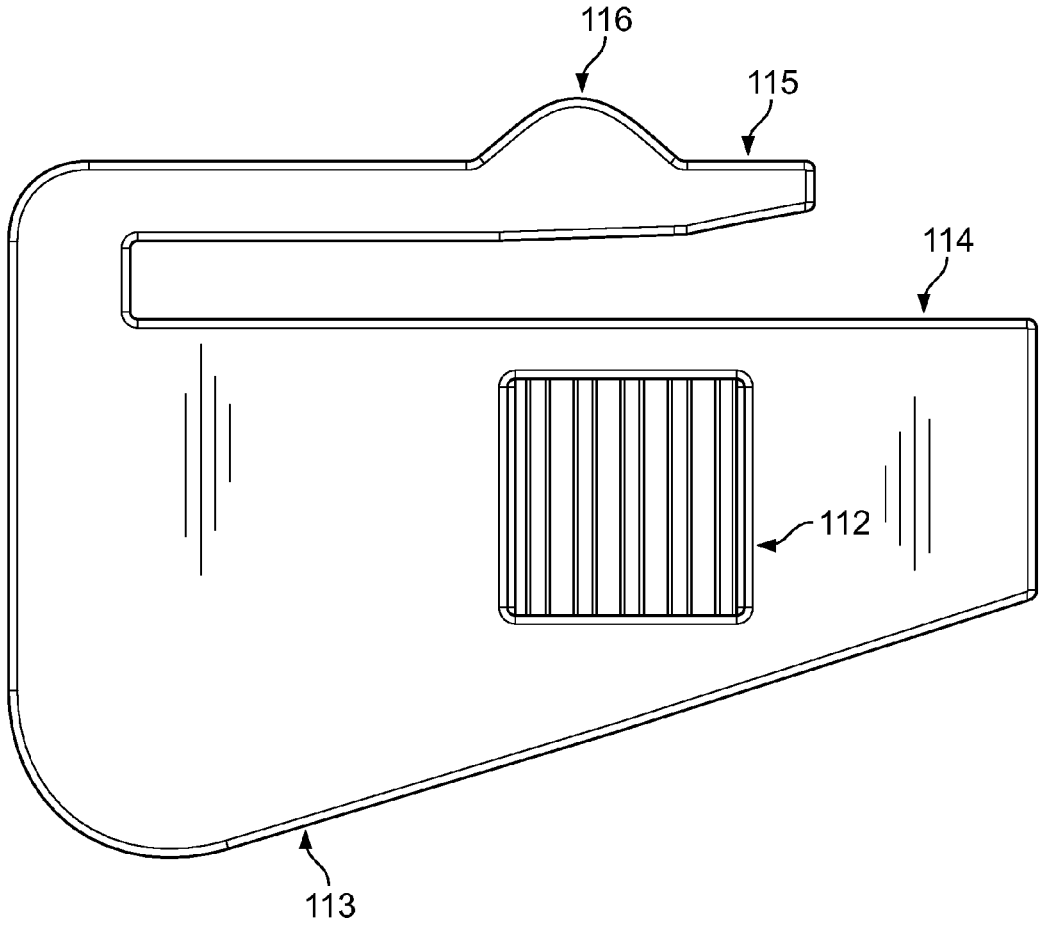
FIG. 1C (Prior Art)
FIG. 1C shows a slide member of a flameless candle.
Figure 1D:
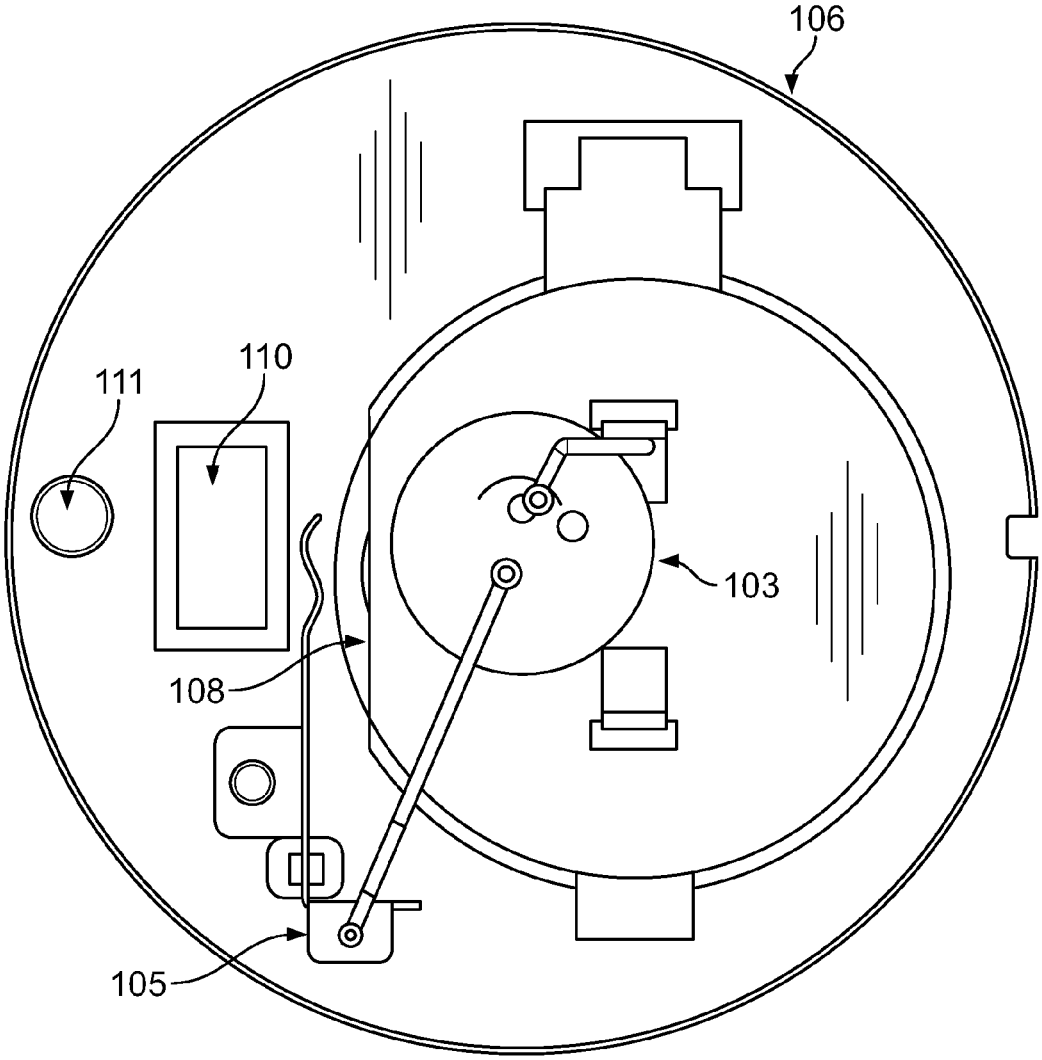
FIG. 1D (Prior Art)
FIG. 1D shows a sub-assembly of a flameless candle.
Figure 1E:
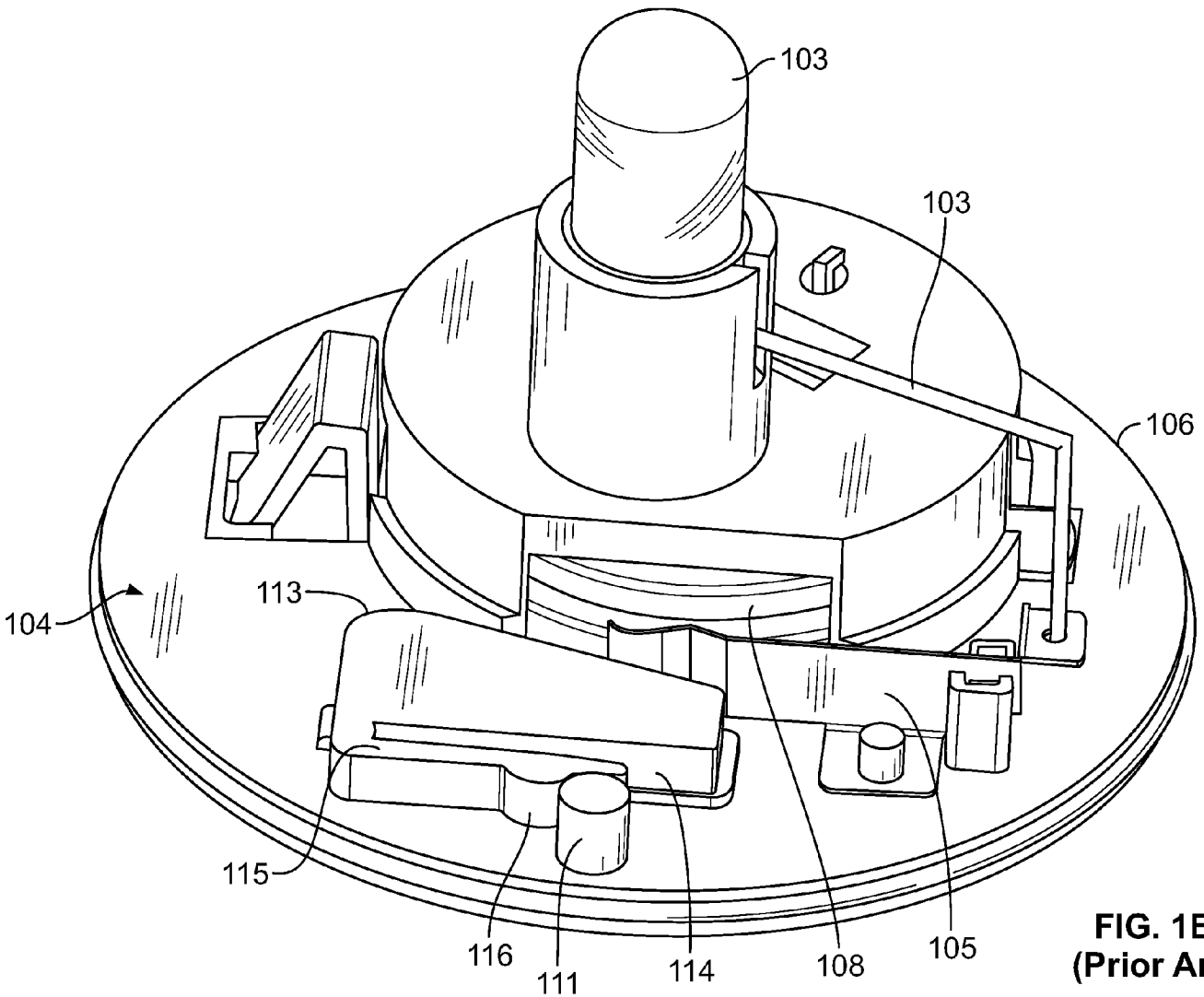
FIG. 1E (Prior Art)
FIG. 1E shows a sub-assembly of a flameless candle.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 2A:
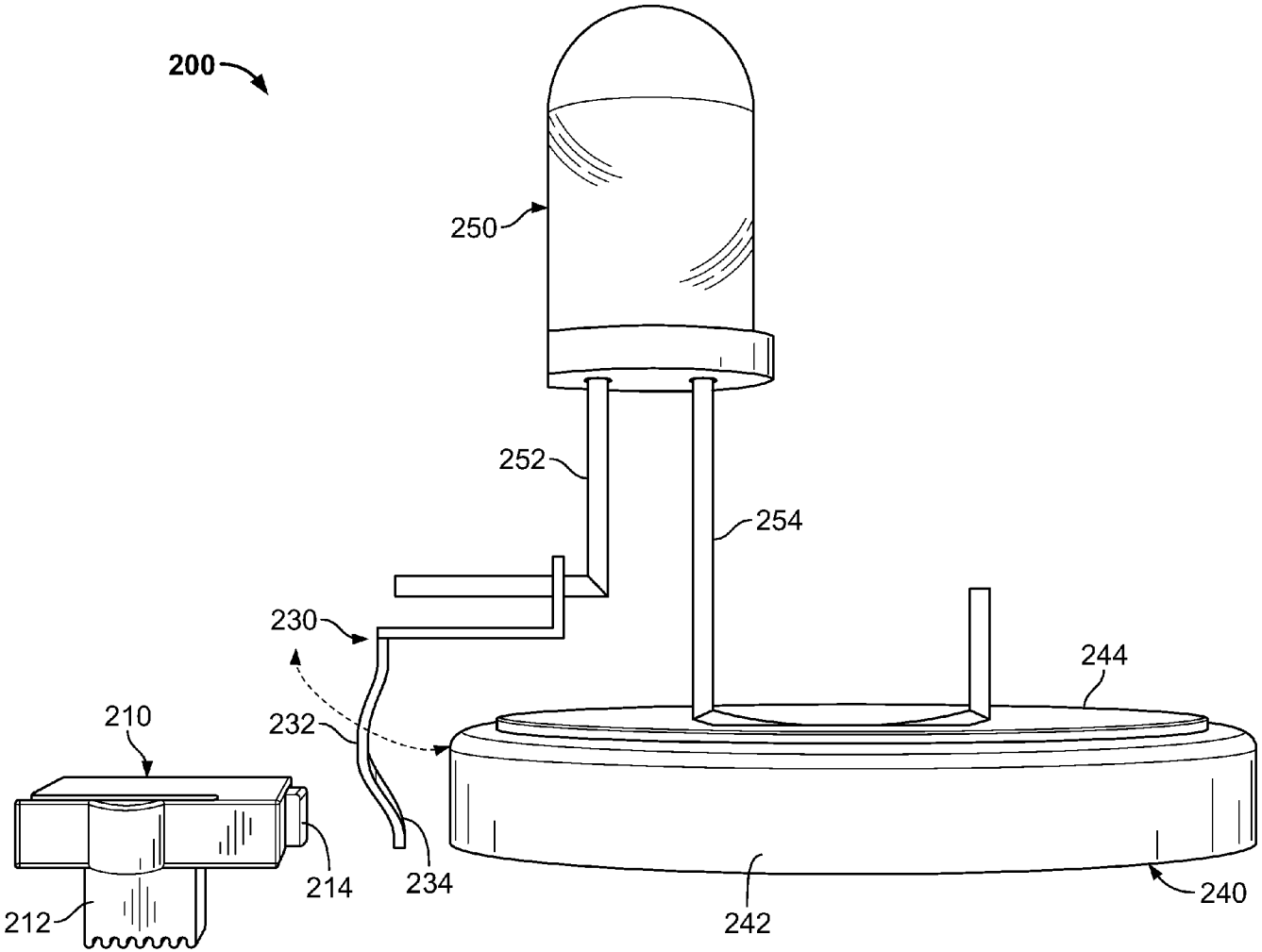
FIG. 2A shows an assembly for a flameless candle, according to an embodiment of the present invention.

FIG. 2A shows an assembly 200 for a flameless candle, according to an embodiment of the present invention. The assembly 200 may include a slide member 210, a battery contact 230, a battery 240, and an LED 250. The assembly 200 may also include a base 220, which has been omitted from FIG. 2A to more clearly illustrate the relationship between other components in assembly 200. The base 220 will be discussed in detail with respect to FIGS. 2D, 2E, and 2F.

The LED 250 may include a first lead 252 and a second lead 254. The LED 250 may include one diode, or may include a plurality of diodes. For example, the LED 250 may include different colored diodes. The LED 250 may have an embedded circuit (not shown) that is configured to cause the LED 250 to emit light of a certain character. For example, the embedded circuit may cause the LED 250 to emit light simulating a candle flicker. The embedded circuit may include, for example, a microcontroller, microprocessor, processor, or the like. The embedded circuit may have a timer loop to turn the LED 250 on and off according to a schedule. For example, the embedded circuit may have a 24 hour timer loop which may be used to turn the LED 250 on at substantially the same time each day. The timer loop may cause the LED 250 to turn off after a specified time period.

The second lead 254 of the LED 250 may be configured to contact the battery 240, for example, at the second terminal 244 of the battery 240. The second lead 254 may be fed into a battery compartment 227 of the base 220 to contact the battery 240. The LED 250 may have additional leads. For example additional leads may be provided to control certain aspects of the LED 250—e.g., cause different colored diodes to turn on/off. The additional leads may also be used to connect to an oscillator (e.g., a crystal oscillator) external to the LED 250.

The battery contact 230 may include a rotatable portion 232 and a mechanical contact portion 234. The rotatable portion 232 may rotate in a vertical plane. Such an example of rotation is illustrated with the dotted line in FIG. 2A. The rotation of rotatable portion 232 may cause the mechanical contact portion 234 to connect/disconnect to/from the battery 240. The battery contact 230, at the mechanical contact portion 234, may be configured to contact the battery 240—for example, at a first terminal 242 of the battery 240. The battery contact 230 may be connected to the first lead 252 of the LED 250. For example, the battery contact 230 may be electrically connected to the first lead 252, for example, with a solder joint. The connection between the battery contact 230 and the first lead 252 may be at a location above the battery 240. The battery contact 230 may also include or even be formed with the first lead 252 of the LED 250. For example, the battery contact 230 may include a plastic portion that guides the first lead 252 of the LED 250 to rotate and mechanically contact the battery 240.

When the mechanical contact portion 234 is connected to the battery 240 (e.g., at the first terminal 242), and the second lead 254 of the LED 250 is connected to the battery 240 (e.g., at the second terminal 244), a current may flow through the LED 250, thereby causing light to emanate from the LED 250. The current and battery voltage may generate power to drive diode(s) in the LED 250 and to operate other embedded circuit(s) in the LED 250.

The slide member 210 may include a protrusion 212 and a nose 214. The protrusion 212 may be configured to facilitate the slide member 210 to be moved, for example, by a finger. When the slide member 210 is moved towards the battery 240, the nose 214 of the slide member 210 may cause the rotatable portion 232 of the battery contact 230 to rotate towards the battery 240. As the slide member 210 continues to move and the nose 214 pushes up against the rotatable portion 232 of the battery contact 230, the mechanical contact portion 234 may contact the battery 240.

Figure 2B:
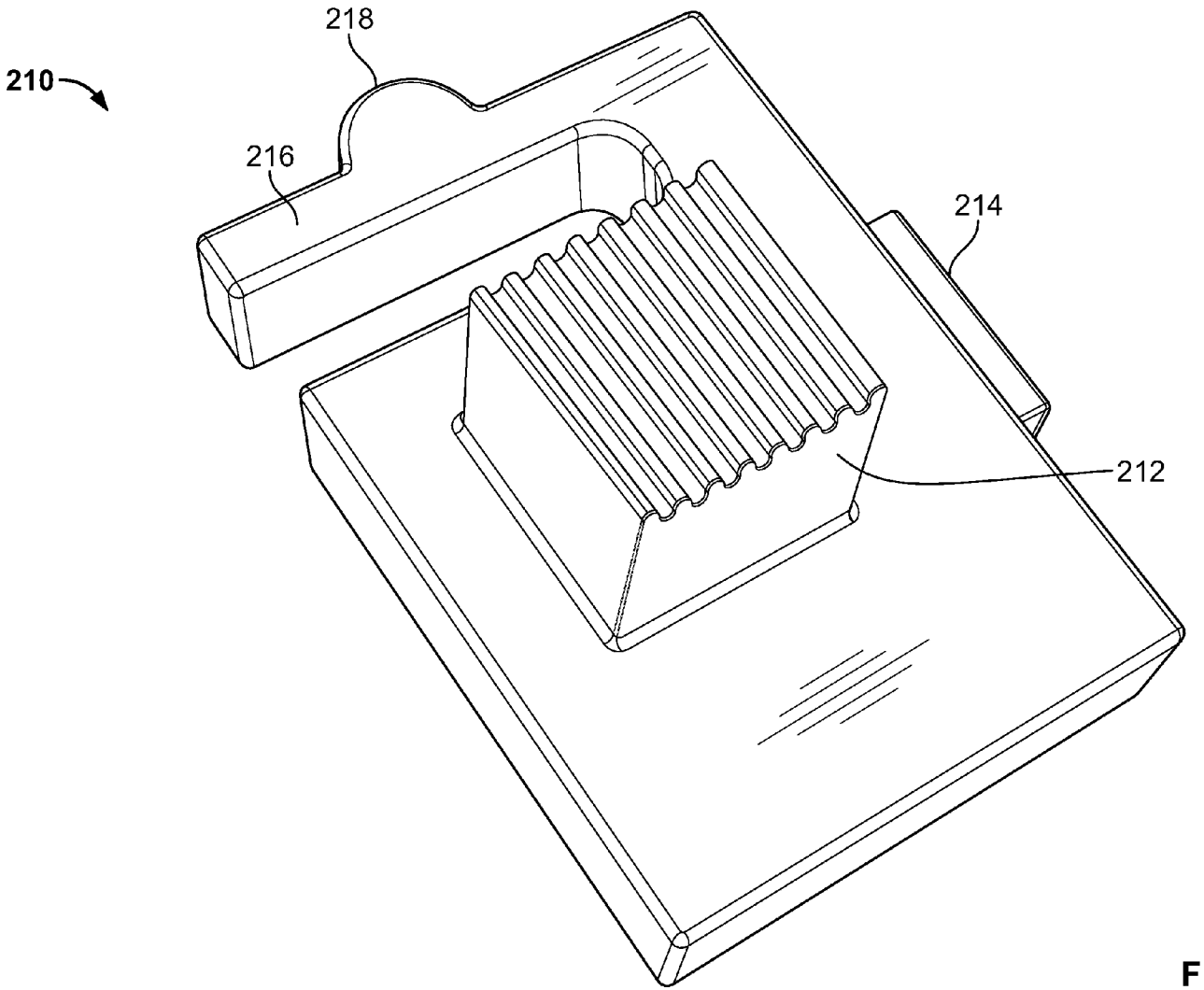
FIG. 2B shows a slide member for a flameless candle, according to an embodiment of the present invention.
Figure 2C:
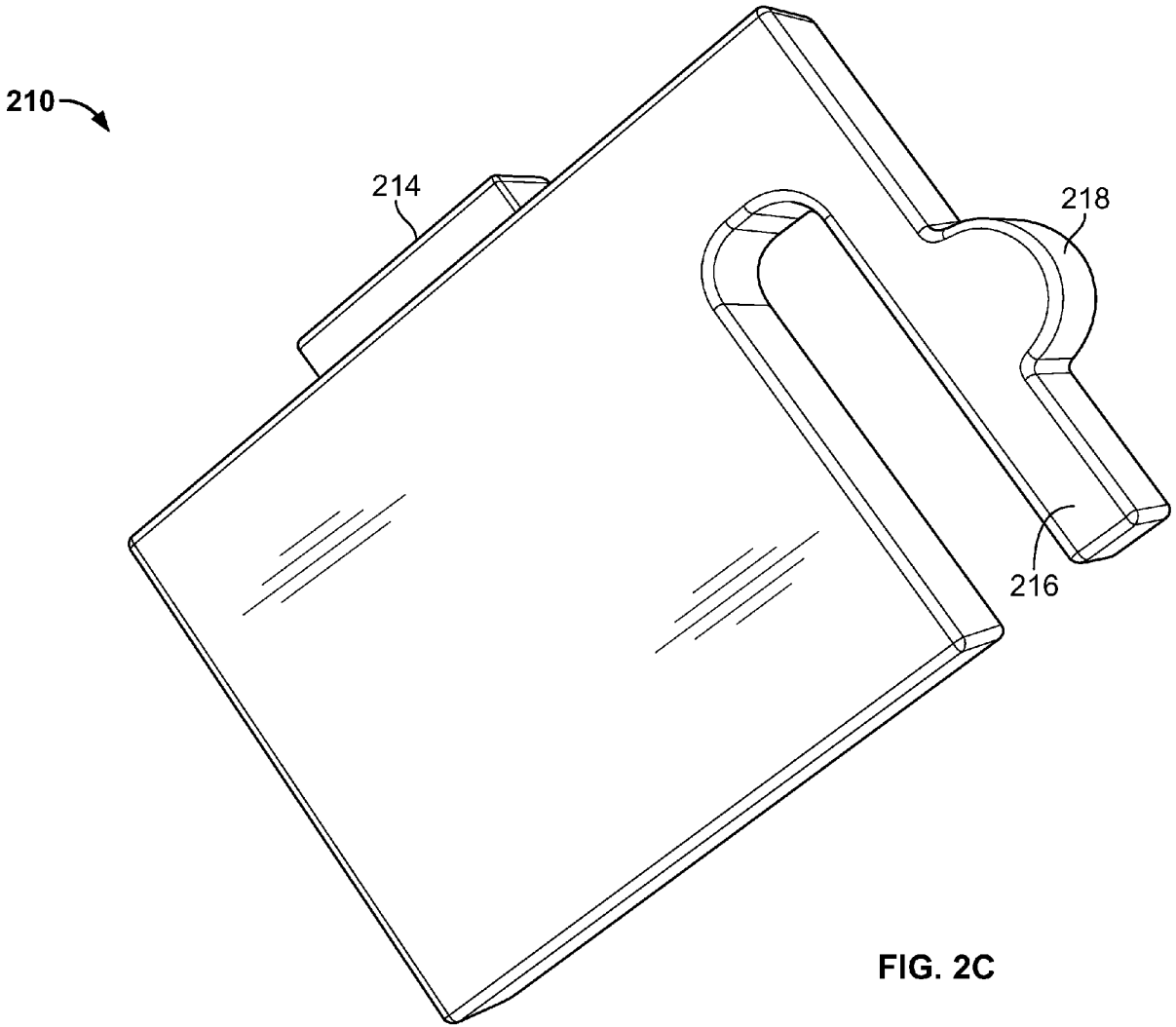
FIG. 2C shows a slide member for a flameless candle, according to an embodiment of the present invention.

Turning to FIGS. 2B and 2C, the slide member 210 is illustrated, according to an embodiment of the present invention. As discussed, the slide member includes a protrusion 212 and a nose 214. The nose 214 has a shape that may cause the rotatable portion 232 of the battery contact 230 to rotate towards the battery. A rectangular-type nose 214 is shown, but other shapes are possible. Furthermore the nose 214 is shown as a projection from the body of the slide member 210, but that need not be the case. Portions of the nose 214, for example, could be recessed or flush with the body of the slide member 210. The slide member 210 may also include a spring arm 216 and a bump 218. The spring arm 216 may be capable of moving, compressing, or extending with respect to the body of the slide member 210 and returning to a static position.

Figure 2D:
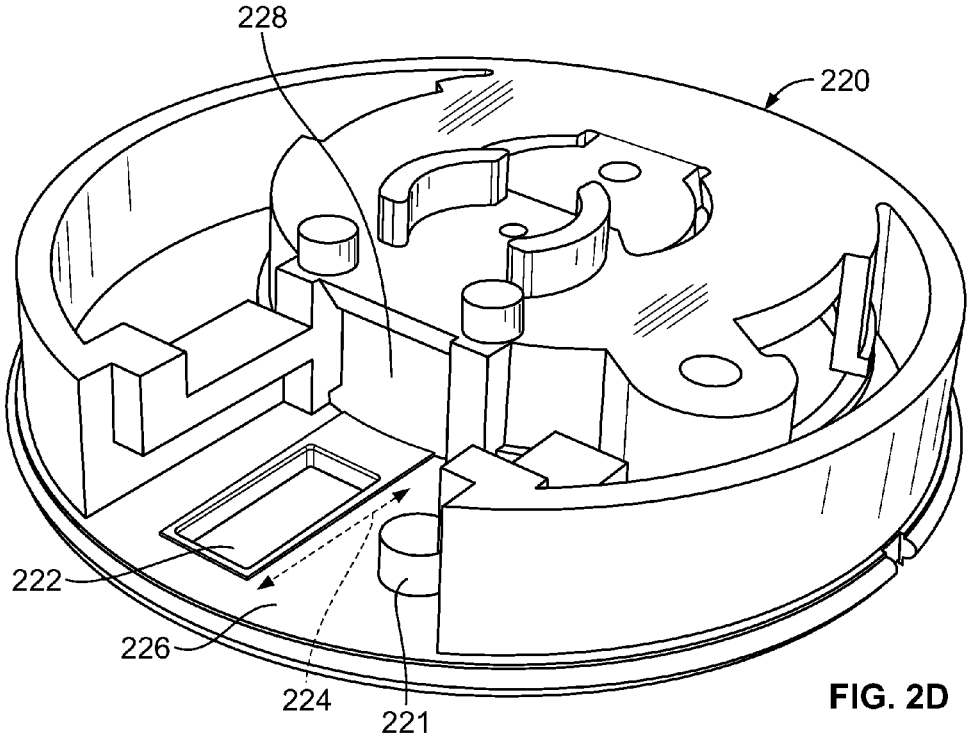
FIG. 2D shows a base for a flameless candle, according to an embodiment of the present invention.

FIG. 2D shows a base 220 for a flameless candle, according to an embodiment of the present invention. The base may include a radial aperture 222, a battery compartment 227 (not shown and on the underside of the base), a battery compartment aperture 228, and a post 221. The battery compartment 227 may be configured to receive a battery 240, such as, for example, a CR2032 lithium cell battery. The battery 240 may be secured in the battery compartment 227 with a door. The door may removably attach to the base 220. There may also be a safety screw to further secure the door to the base 220. The base 220 may be configured to rest on a horizontal surface.

Figure 2E:
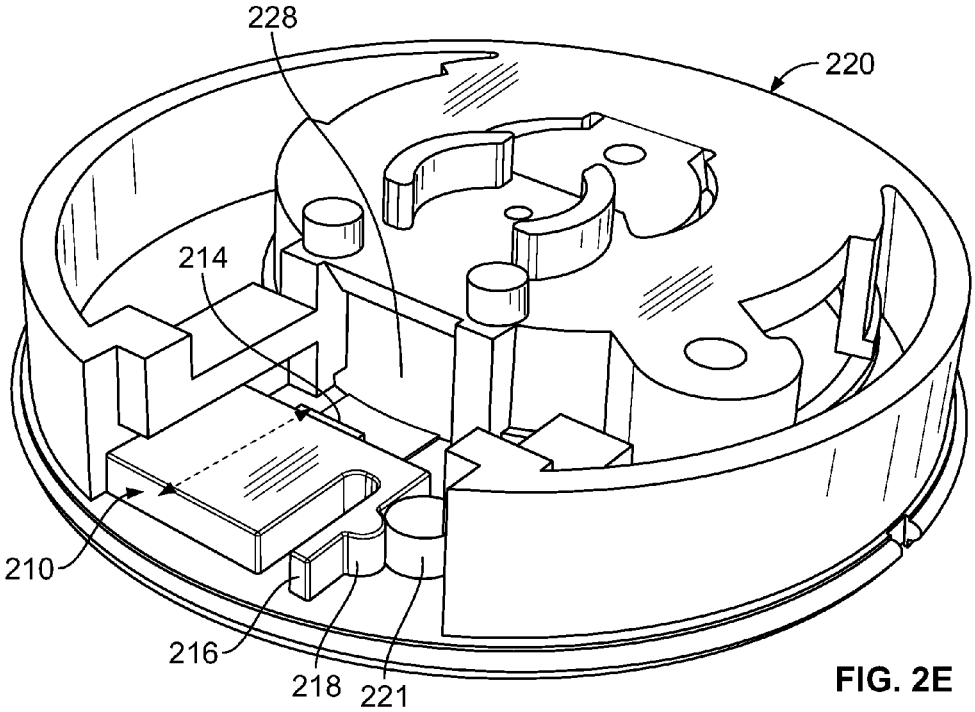
FIG. 2E shows a base and a slide member for a flameless candle, according to an embodiment of the present invention.
Figure 2F:
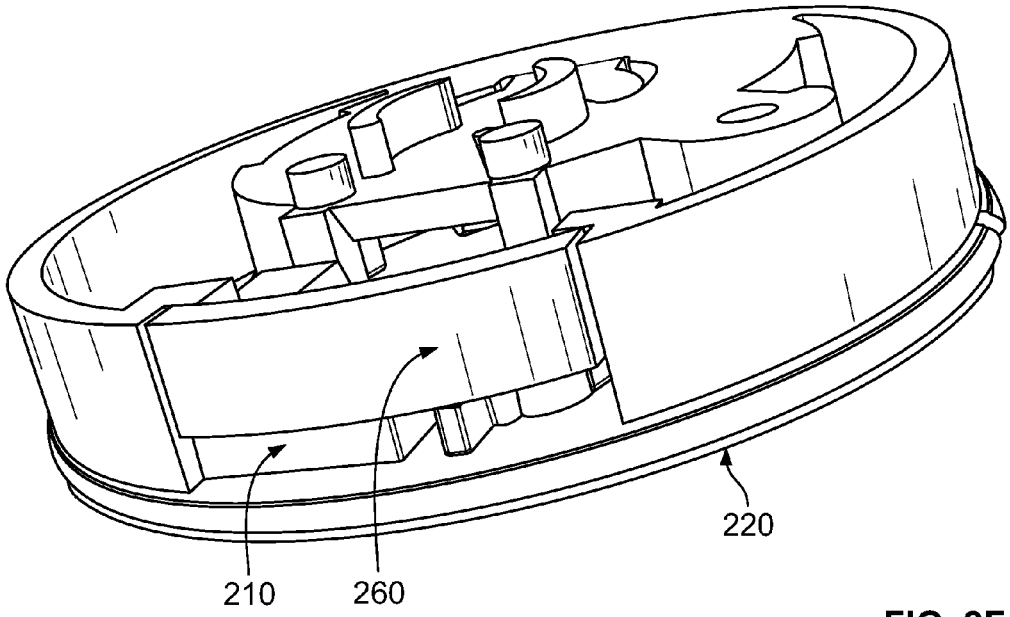
FIG. 2F shows a base, a drawer, and a slide member for a flameless candle, according to an embodiment of the present invention.
Figure 2G:
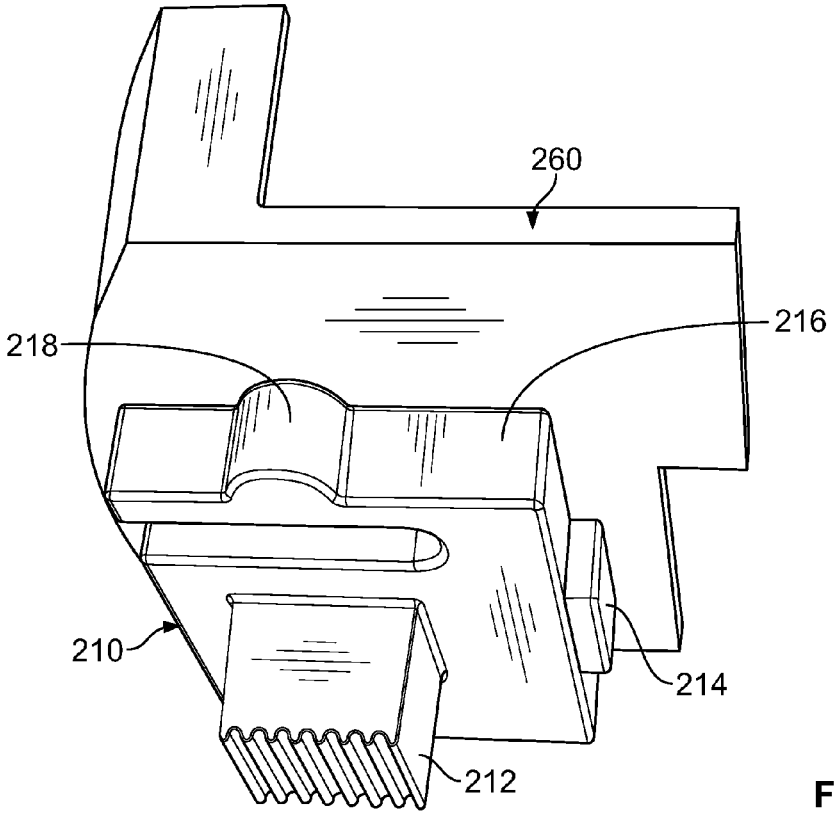
FIG. 2G shows a slide member and a drawer for a flameless candle, according to an embodiment of the present invention.
Figure 2H:
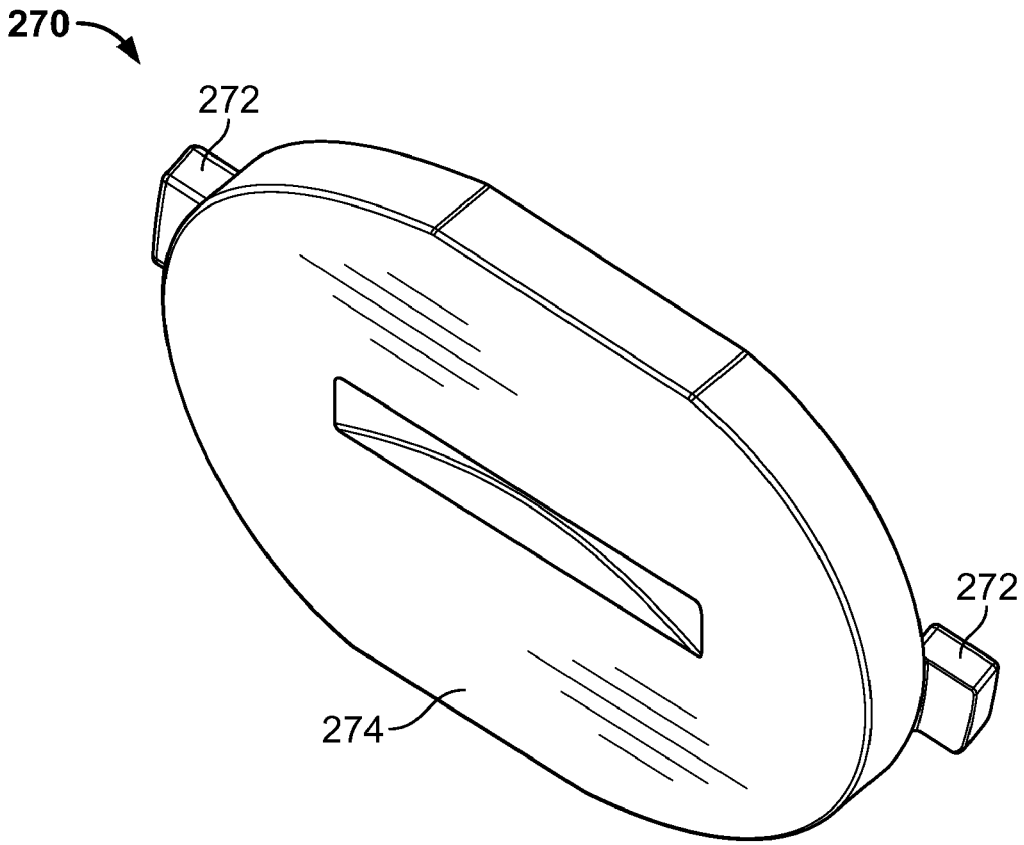
FIG. 2H shows a bayonet door, according to an embodiment of the present invention.

Turning for a moment to FIG. 2H, a door may be a bayonet door 270. The bayonet door 270 may have one or more flanges 272 and a face 274. The flanges 272 may be configured to mate with the base 220. For example, the base 220 may have grooved portions (not shown) to receive the flanges 272. When the bayonet door 270 is rotated, it may "screw" into the base 220 as the flanges 272 move up the grooved portions.

Turning back to FIG. 2D, the radial aperture 222 may be configured along a radial direction of the base 220—e.g., generally extending from the center area towards the perimeter of the base 220. The radial aperture 222 may be in a horizontal plane—e.g., in a horizontal orientation substantially parallel to a surface upon which the base 220 rests. The radial aperture 222 may be sized to receive the protrusion 212 of the slide member 210. The radial aperture 222 may be oriented to permit a movement of the slide member 210 in a corresponding radial direction. For example, the radial direction may have an inward position 224 and an outward position 226.

The protrusion 212 may be configured to allow a user to move the position of the slide member 210. For example, a user may put pressure with a finger or fingernail on the protrusion 212 to slide the slide member 210. The protrusion 212 may protrude downwardly from the general plane of the slide member 210. For example, the general plane of the slide member 210 may be horizontal and the protrusion 212 may extend downward in a vertical direction from the general plane of the slide member 210.

The protrusion 212 may be able to move between the inward position 224 and the outward position 226. When the protrusion 212 is located at the inward position 224, the slide member 210 may be in an ON position. When the slide member 210 is moved to the ON position, the nose 214 may deflect the rotatable portion 232 of the battery contact 230 (not shown in FIG. 2D) to make an electrical connection with the battery 240. For example, the mechanical contact 234 on the rotatable portion 232 may move through the battery compartment aperture 228 to make the connection with the battery 240. When the protrusion 212 is located at the outward position 226, the slide member 210 may be in an OFF position. The slide member also has an OFF position when located at an outwards position along the radial direction. When the slide member 210 is moved to the OFF position, the nose 214 may allow the rotatable portion 232 of the battery contact 230 to relax, thereby breaking an electrical connection with the battery 240.

FIG. 2E shows a base 220 and a slide member 210 for a flameless candle, according to an embodiment of the present invention. As can be seen, when slide member 210 travels along the radial direction (illustrated with the two-headed dotted-line arrow) between the ON and OFF positions, the bump 218 on the spring arm 216 will cross over the post 221. When the bump 218 crosses the post 221, the spring arm 216 is compressed. After the bump 218 crosses the post 221, the spring arm 216 is decompressed. The spring arm 216 may be decompressed when the slide member 210 is in the ON or OFF positions. When the spring arm 216 decompresses (along with the bump 218), a sound may be produced. The sound may provide a user with feedback, such that the user knows that the slide member 210 has entered the ON or OFF position.

The resistance of the spring arm 216 may tend to keep the slide member 210 in the ON or OFF position. For example, the presence of the spring arm 216 and the bump 218 may increase the force that should be exerted on the slide member 210 to cause it to travel between the ON and OFF positions. Furthermore, the spring arm 216 has a tendency to decompress—e.g., return to its static position. The spring arm 216 may be configured to snap the slide member 210 into the ON position as the slide member 210 is moving towards the ON position and the spring arm 216 is decompressing. Similarly, the spring arm 216 may be configured to snap the slide member 210 into the OFF position as the slide member 210 is moving towards the OFF position and the spring arm 216 is decompressing.

FIG. 2F shows a base 220, a drawer 260, and a slide member 210 for a flameless candle, according to an embodiment of the present invention. FIG. 2G shows only the slide member 210 and the drawer 260 to illustrate a different view. The drawer 260 may be configured with the base 220 such that the drawer 260 may slidably engage with the base. The drawer 260 may be located above the slide member 210 and may prevent the slide member from becoming displaced. For example, the drawer 260 may keep the protrusion 212 of the slide member 210 from coming out of the radial aperture 222 and becoming vertically or horizontally displaced (e.g., not in a functional location).

Figure 3:
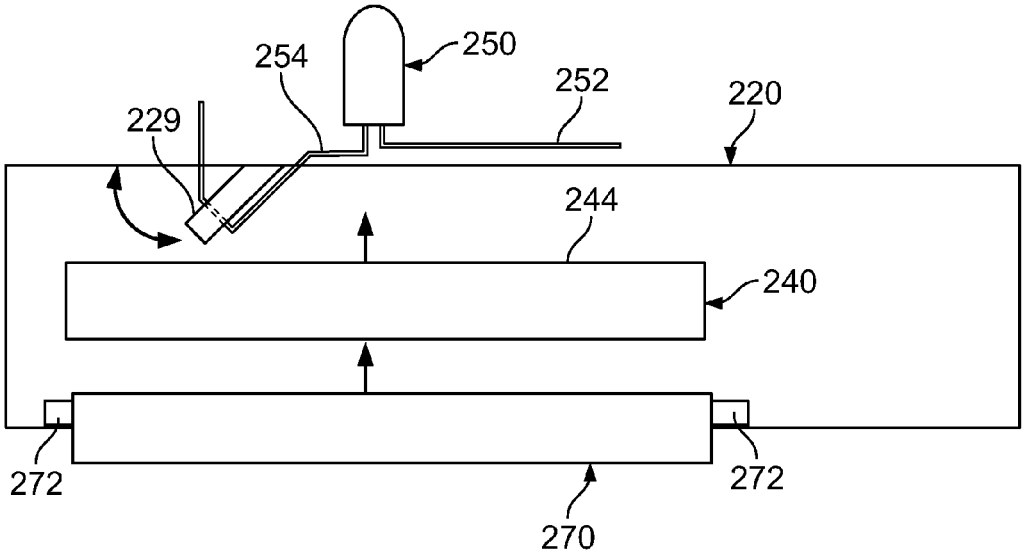
FIG. 3 shows a side view illustration of a portion of a flameless candle, according to an embodiment of the present invention.

Turning to FIG. 3 a side view illustration of a portion of a flameless candle is shown, according to an embodiment of the present invention. A general relationship between base 220, LED 250, battery 240, and door 270 is shown. The door 270 is shown to be a bayonet door, but other possible door types may also be suitable.

The base 220 may include a battery compression arm 229. The battery compression arm 229 in conjunction with the door 270 may work to facilitate a contact between the second terminal 244 of the battery 240 and the second lead 254 of the LED 250. The battery compression arm 229 may, for example, be formed as part of a plastic molding that forms the base 220. The battery compression arm 229 may be oriented at a downward-sloping angle with respect to the top plane of the base 220. The second lead 254 of the LED 250 may be fed through the top plane of the base 220, around and through the battery compression arm 229.

The door 270 may removably mate with the base 220. For example, the door 270 may be a bayonet door with flanges 272. The base 220 may have grooved portions (not shown) to receive the flanges 272. As the door 270 is rotated, it may be drawn upwards into the base 220, as depicted by the upwards pointing arrow from the door 270 towards the battery 240. As the door 270 is drawn up, it may push the battery 240 up towards the battery compression arm 229, as depicted by the upwards pointing arrow pointing from the second terminal 244 of the battery 240.

When the battery 240 is pushed up, the second terminal 244 may be pushed against the battery compression arm 229 and the second lead 254 of the LED 250. The battery compression arm 229 may then compress towards the top plane of the base 220, as illustrated by the arc-shaped arrow. As it is compressed, the battery compression arm 229 exerts a force back towards the second terminal 244 of the battery 240. As this happens, the second lead 254 of the LED 250 is pushed down against the second terminal 244 of the battery 240. Thus, the battery 240 becomes sandwiched between the door 270 and the battery compression arm 229 in combination with the second lead 254 of the LED 250. The sandwiching facilitates to stabilize the battery 240 and to improve the contact between the second lead 254 of the LED 250 and the second terminal 244 of the battery 240.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A flameless candle comprising:

a slide member including a protrusion and a nose;

a base including a radial aperture in a horizontal plane configured to:

receive the protrusion, and permit a movement of the slide member in a corresponding radial direction, wherein the slide member has an ON position when the protrusion is located at an inwards position along the radial direction, and wherein the slide member has an OFF position when the protrusion is located at an outwards position along the radial direction; and a battery contact including a rotatable portion and a mechanical contact portion, wherein the nose is configured to:

rotate the rotatable portion as the slide member moves between the ON position and the OFF position, and cause the mechanical contact portion to contact a battery when the slide member is in the ON position.

2. The flameless candle of claim 1, wherein the rotatable portion is configured to rotate in a vertical plane.

3. The flameless candle of claim 1, wherein the base further comprises:

a battery compartment configured to receive a battery; and a battery compartment aperture, wherein the mechanical contact portion is configured to contact the battery through the battery compartment aperture.

4. The flameless candle of claim 1, further comprising a drawer configured to slidably engage with the base and to prevent the slide member from being displaced.

5. The flameless candle of claim 1, wherein the base further comprises a post;

the slide member further comprises a spring arm configured to be:

decompressed when the slide member is in the ON position and the OFF position, and compressed when a bump on the spring arm crosses the post as the slide member travels between the ON position and the OFF position; and the spring arm is further configured to:

snap the slide member into the ON position as the slide member is travelling towards the ON position and the spring arm is decompressing, and snap the slide member into the OFF position as the slide member is travelling towards the OFF position and the spring arm is decompressing.

6. The flameless candle of claim 1, further comprising a bayonet door including a flange and configured to rotatably mate with a grooved portion on the base and to contain the battery within the battery compartment.

7. The flameless candle of claim 3, further comprising a light emitting diode ("LED").

8. The flameless candle of claim 7, wherein the LED further comprises an embedded circuit configured to cause the LED to emit light simulating a candle flicker.

9. The flameless candle of claim 7, wherein a first lead of the LED is connected to the battery contact.

10. The flameless candle of claim 7, wherein both the mechanical contact portion and the rotatable portion of the battery contact include a portion of the first lead of the LED.

11. The flameless candle of claim 9, wherein a second lead of the LED is fed into the battery compartment, and current flows through the LED when the mechanical contact portion contacts a first terminal of the battery and the second lead of the LED contacts the second terminal of the battery.

12. The flameless candle of claim 9, wherein the first lead of the LED is connected to the battery contact at a location above the battery.

13. The flameless candle of claim 11, wherein the base includes a battery compression arm configured to push the second lead of the LED against the second terminal of the battery.

14. The flameless candle of claim 13, further comprising a door configured to:

contain the battery within the battery compartment, push the battery towards the battery compression arm and the second lead of the LED, and cause the battery compression arm to compress, wherein the compressed battery compression arm is configured to push the second lead of the LED against the second terminal of the battery when the battery compression arm is compressed.

15. The flameless candle of claim 14, wherein the door comprises a bayonet door including a flange and configured to rotatably mate with a grooved portion on the base.

16. The flameless candle of claim 5, wherein the spring arm is further configured to cause a sound and provide feedback that the slide member has entered the ON position or the OFF position.

* * * * *